US008272672B2

(12) United States Patent
Huecker et al.

(10) Patent No.: US 8,272,672 B2
(45) Date of Patent: Sep. 25, 2012

(54) SUSPENSION DEVICE

(75) Inventors: Rolf Huecker, Kreuztal (DE); Kurt Scheffe, Hilchenback (DE)

(73) Assignee: SMS Siemens AG, Duesseldorf (DE)

( * ) Notice: Subject to any disclaimer, the term of this patent is extended or adjusted under 35 U.S.C. 154(b) by 178 days.

(21) Appl. No.: 12/657,200

(22) Filed: Jan. 13, 2010

(65) Prior Publication Data

US 2010/0176613 A1 Jul. 15, 2010

(51) Int. Cl.
*B66C 1/00* (2006.01)

(52) U.S. Cl. ..... 294/67.5; 294/67.21; 294/82.16

(58) Field of Classification Search ..... 294/67.21, 294/67.5, 81.3, 82.12, 82.16; 269/254 CS, 269/143, 249
See application file for complete search history.

(56) References Cited

U.S. PATENT DOCUMENTS

| | | | | |
|---|---|---|---|---|
| 1,807,360 | A * | 5/1931 | Wehr | 294/106 |
| 2,370,528 | A * | 2/1945 | Fontaine | 294/197 |
| 4,626,012 | A * | 12/1986 | Weldele | 294/81.3 |
| 5,188,247 | A * | 2/1993 | Jastrow | 212/343 |
| 5,660,422 | A * | 8/1997 | Knisley | 294/67.33 |
| 5,671,960 | A * | 9/1997 | Chyz | 294/81.3 |
| 5,800,000 | A * | 9/1998 | Shockley | 294/81.3 |
| 6,024,394 | A * | 2/2000 | Marler | 294/75 |
| 2005/0248156 | A1 * | 11/2005 | Hsieh | 285/397 |

* cited by examiner

*Primary Examiner* — Dean Kramer
*Assistant Examiner* — Stephen Vu
(74) *Attorney, Agent, or Firm* — Abelman, Frayne & Schwab

(57) ABSTRACT

A suspension device for receiving a load includes a U-shaped lifting arm, a mounting plate for receiving a load and provided on the lifting arm, a guide rod extending between the legs of the U-shaped lifting arm, a suspending fishplate displaceable along the guide rod for suspending the suspension device from a lifting/support unit, and a damping member arranged between one of the legs of the U-shaped arm and the suspending fishplate, with a stiffness of the damping member being selected to a predetermined angle to a horizontal.

2 Claims, 6 Drawing Sheets

NEW SHEET

SUSPENSION DEVICE

BACKGROUND OF THE INVENTION

1. Field of the Invention

The present invention relates to a suspension device for receiving a load.

2. Description of the Prior Art

A suspension device for receiving a load is known. An embodiment of such a device is shown in FIG. 4. In FIG. 4, the suspension device 100 is designed for receiving a load in form of a bearing-mounting tool 200. The suspension device 100 has a mounting L-shaped plate 116 to which two legs 112, 114 are welded. Between the legs 112, 114, there is provided a guide rod 130 secured thereto by threaded means. The guide rod is formed as a threaded rod and can be formed as a hexagonal bolt. A suspending fishplate 120 is displaceably supported on the guide rod 130. Because of their large weight, such suspension devices can only be moved with a crane. With the suspension device being suspended on a lifting/support unit, the changing of mass distribution, e.g., upon displacement of a piston 210 within the bearing-mounting tool in one of opposite directions, would result in displacement of the gravity center. The displacement of the gravity center leads to an inclination or slant position of the suspension device, together with the bearing-mounting tool, which makes the positioning of the suspension device, together with the bearing-mounting tool with respect to a bearing arranged on a shaft more difficult. The ring-shaped suspending fishplate 120 for the suspension device with the bearing-mounting tool, in case of a load, can be adjusted with the guide rod 130 only within certain limits. A precise horizontal alignment with this adjustment unit is possible only for a predetermined piston position.

An object of the present invention is to so modify the known suspension device for receiving a load that the suspension device is swingable horizontally with a desired inclination angle.

SUMMARY OF THE INVENTION

This and other objects of the present invention, which will become apparent hereinafter, are achieved by arranging a damping member between one of the legs of a U-shaped arm and the suspending fishplate, with a stiffness of the damping member being so selected that the load is swingable to a predetermined angle to a horizontal.

Below, under a load is understood a weight of any body suspended on the suspension device. In the embodiment discussed here, the load is a bearing-mounting tool for mounting or dismounting a bearing on or from, respectively, a journal of a rolling mill stand roll, with, optionally, other components supported on the tool. The change of the mass distribution of the load is carried out by changing position of the piston arranged in the bearing-mounting tool. The torsion moment change is effected by displacing the piston in one of two opposite directions. The displacement of the piston leads to changing of the gravity center of the suspension device with the bearing-mounting tool.

The present invention permits, by selecting a corresponding stiffness of the damping member, to provide for preferably horizontal swinging of the load suspended on the suspension device. Different load regions can be preset by a corresponding selection of the stiffness of the damping member. According to the present invention, the bearing-mounting tool can be slipped on a roll journal and horizontally aligned with respect to a mountable/dismountable bearing. Fine correction can be carried out by a light application of force from outside, e.g., by manually displacing the suspension device or by using a lever.

According to a preferred embodiment of the invention, the damping member is formed as a spring. The advantage of a spring consists in that the spring is a conventional, economical component that can be obtained with a very fine gradation of the stiffness and is easily mountable and dismountable. According to the invention, the spring surrounds the guide rod.

For adjusting a spring preloads according to the invention, there is provided a tensioning device provided on at least one end of the guide rod for adjusting the preload of the spring. The tensioning device can be formed, e.g., of a spacer sleeve, a hexagonal nut used as a tensioning nut, and a hexagonal nut used as counter-nut. The advantage of the tensioning device according to the invention consist in that in a simple way, a very fine adjustment and correction of the angular position of the bearing-mounting tool with respect to a horizontal, dependent on the applied load, can be carried out. Fine adjustment can cover a relatively large load region, within a preselected load range, within which the suspension device, together with the bearing-mounting tool, is horizontally swingable and very finely adjustable.

According to a further embodiment of the invention, the damping member is formed by one of hydraulic cylinder, pneumatic cylinder, and a plastic element.

The damping system of the inventive suspension device is characterized in that the stiffness of the damping member is selected according to the amount of mass and mass distribution of the applied mass with regard to a desired inclination angle. By pre-selecting the stiffness of the damping member dependent on the applied load, a gradation in different load degrees can be effected.

The selection of the stiffness of the damping element is advantageously so carried out that the desired angle is adjustable with a deviation of at most 1°. The advantage of such a selection consists in that the damping member with a stiffness pre-selected for a predetermined load, already produces a very precise swinging of the bearing-mounting tool within the predetermined load range.

According to an advantageous embodiment of the invention, a final adjustment of the inclination angle is carried out by adjustment of the preload of the damping member.

According to the present invention, the base plate of the lifting arm is provided with an elongate opening for receiving the suspending fishplate displaceable and differently positionable in the elongate opening in the base plate. This facilitates the adjustment of the suspension device, together with the bearing-mounting tool.

According to the invention, running rollers are provided on opposite sides of the suspending fishplate for displaceably supporting the base plate of the lifting arm. The advantage of the use of running rollers consists in that the friction force during swinging is noticeably reduced, and the suspending fishplate is rollingly displaced along the bottom of the base plate upon changing of the load. The fishplate is displaced by the running rollers.

According to a further advantageous embodiment of the invention, the legs of the lifting arm and the mounting plate are formed as a one-piece element, and the mounting plate extends with respect to the base plate on an angle less than, equal to, or more than 90°.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1A:
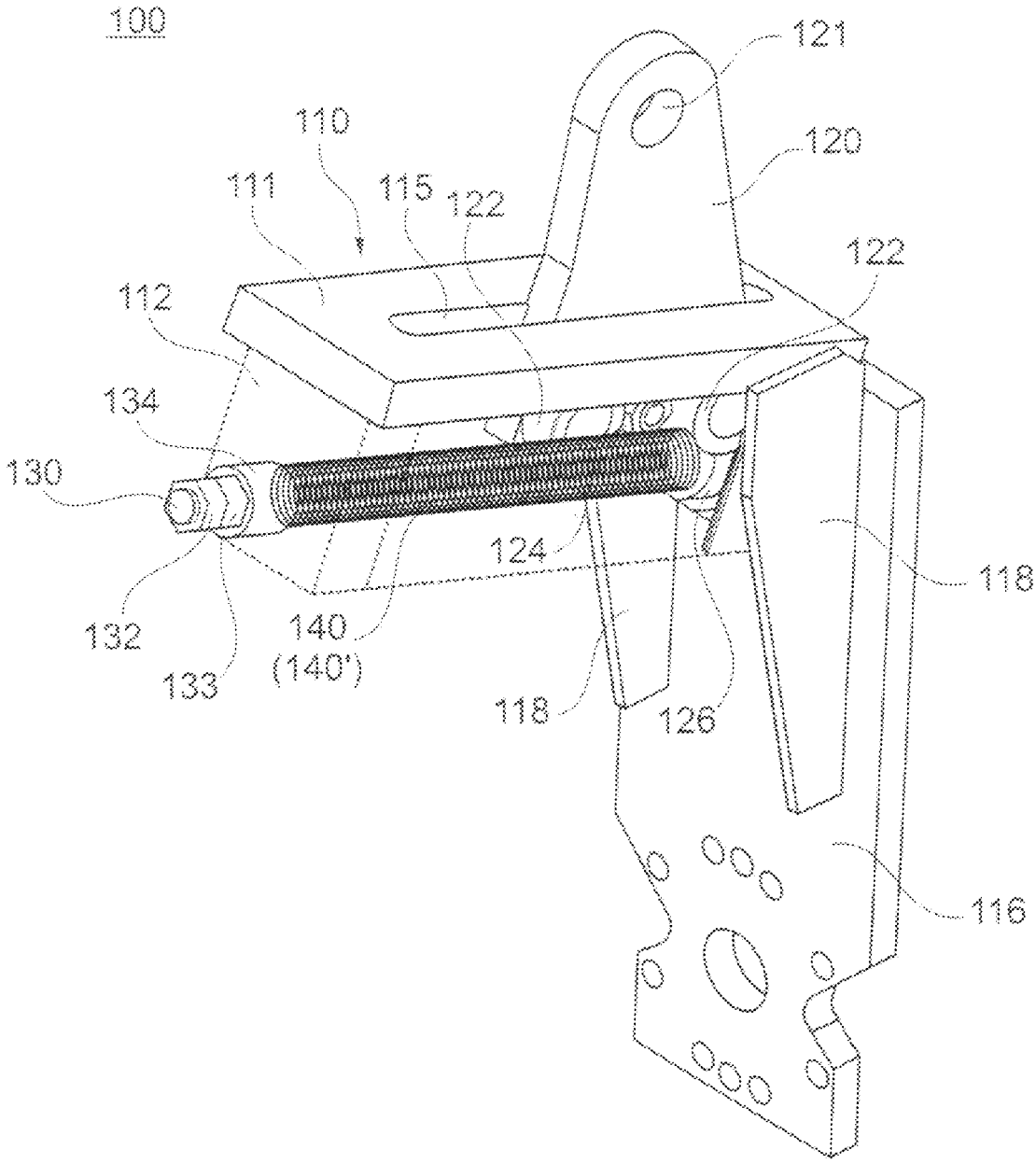
FIG. 1*a* a perspective view of a suspension device according to the present invention.
Figure 1B:
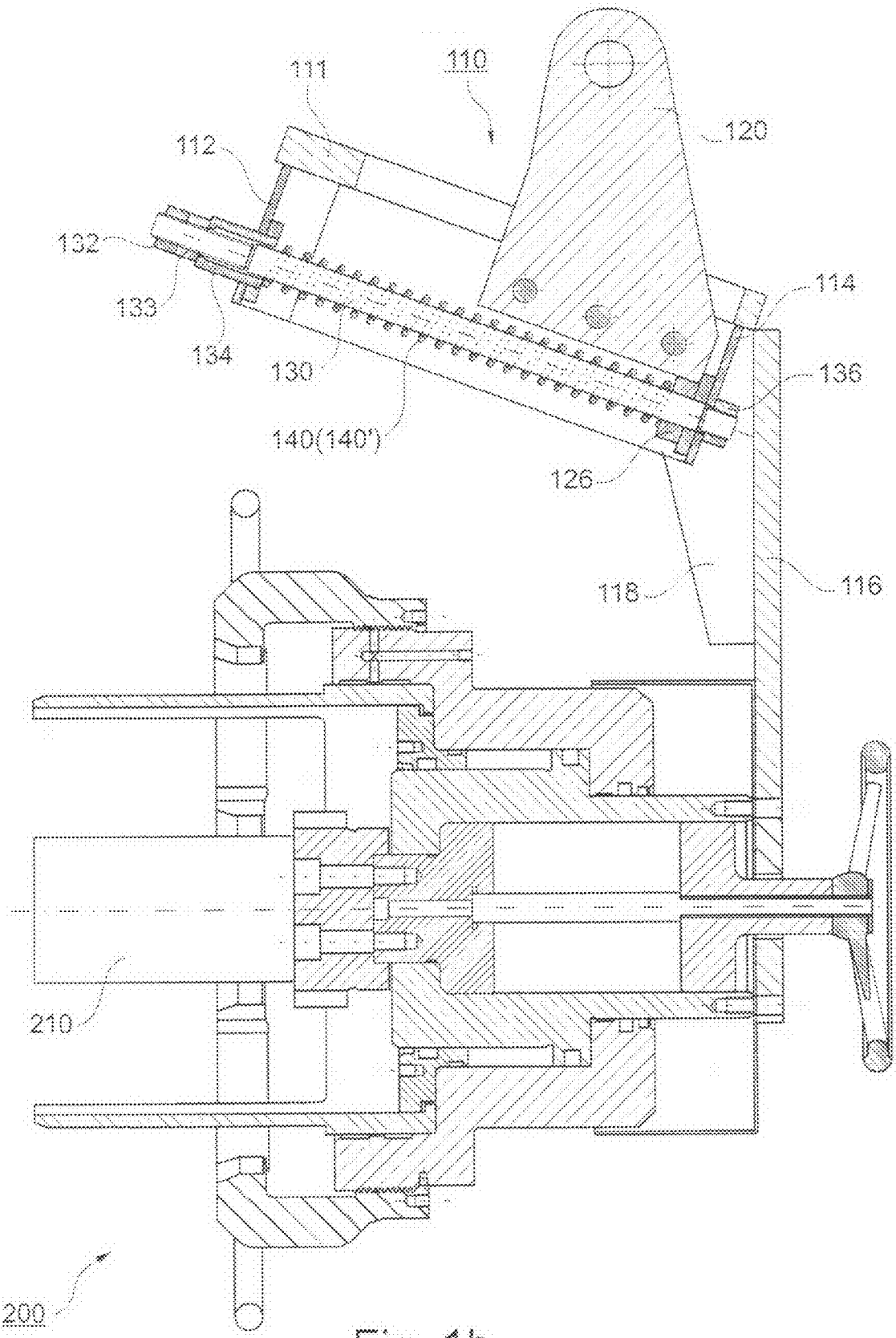
FIG. 1*b* a cross-sectional view of the suspension device shown in FIG. 1*a* with a bearing-mounting tool received thereon.

A suspension device 100 according to the present invention for receiving a load, which is shown in F*igs*. 1*a* and 1*b*, includes a U-shaped lifting arm 110 formed of a base plate 111 and two legs 112, 114 extending at an angle thereto, and a mounting plate 116 arranged on the lifting arm 110. In the embodiment shown in the drawings, the mountings plate 116 is formed for receiving a load in form of a bearing-mounting tool 200, as shown in F*ig*. 1*b*.

At the lower end of the mounting plate 116, there are provided corresponding bores and recesses or guide elements for receiving the bearing-mounting tool 200. For reinforcing the suspension device 100, there are provided web plates 118 that connect the lifting arm 110 with the mounting plate 116. In the base plate 111 of the lifting arm 110, there is provided an elongate opening 115 for receiving a suspending fishplate 120. Each of the legs 112, 114 secured to the base plate 111, has a bore for receiving a guide rod 130. In the embodiment shown in the drawings, on the guide rod 130, there is arranged a damping member 140 in form of a spring 140' that surrounds the guide rod 130. For adjusting the spring preload force, on one end of the guide rod 130, there is provided a tensioning device formed, e.g., of a spacer sleeve 134, hexagonal nut 133 as a tensioning nut, and hexagonal nut 132 as a counter-nut. In the embodiment shown in the drawings, another hexagonal nut 136 is provided on an opposite end of the guide rod 30.

Figure 3:
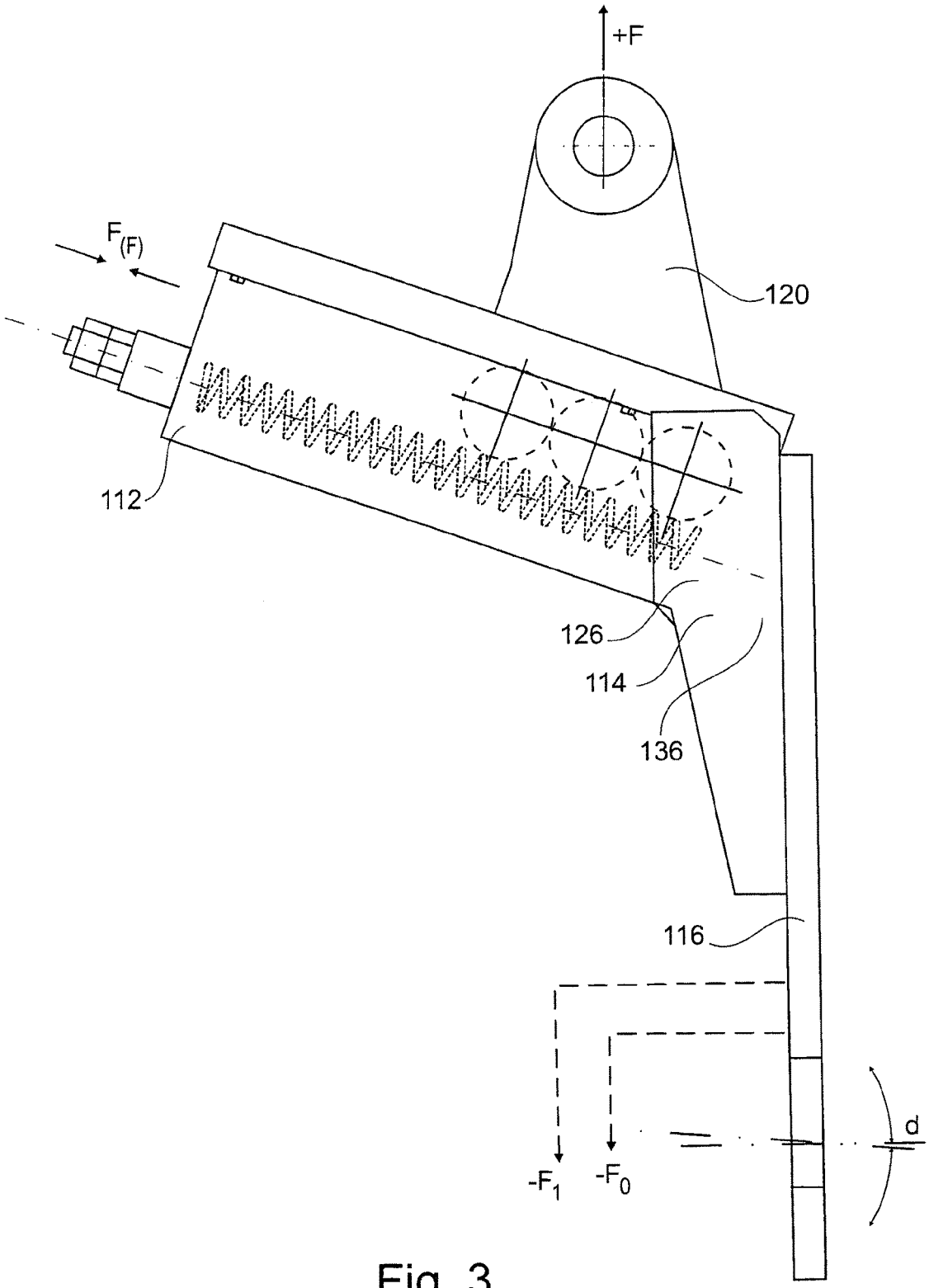
FIG. 3 a schematic view of the suspension device illustrating distribution of forces in a suspension.
Figure 3A:
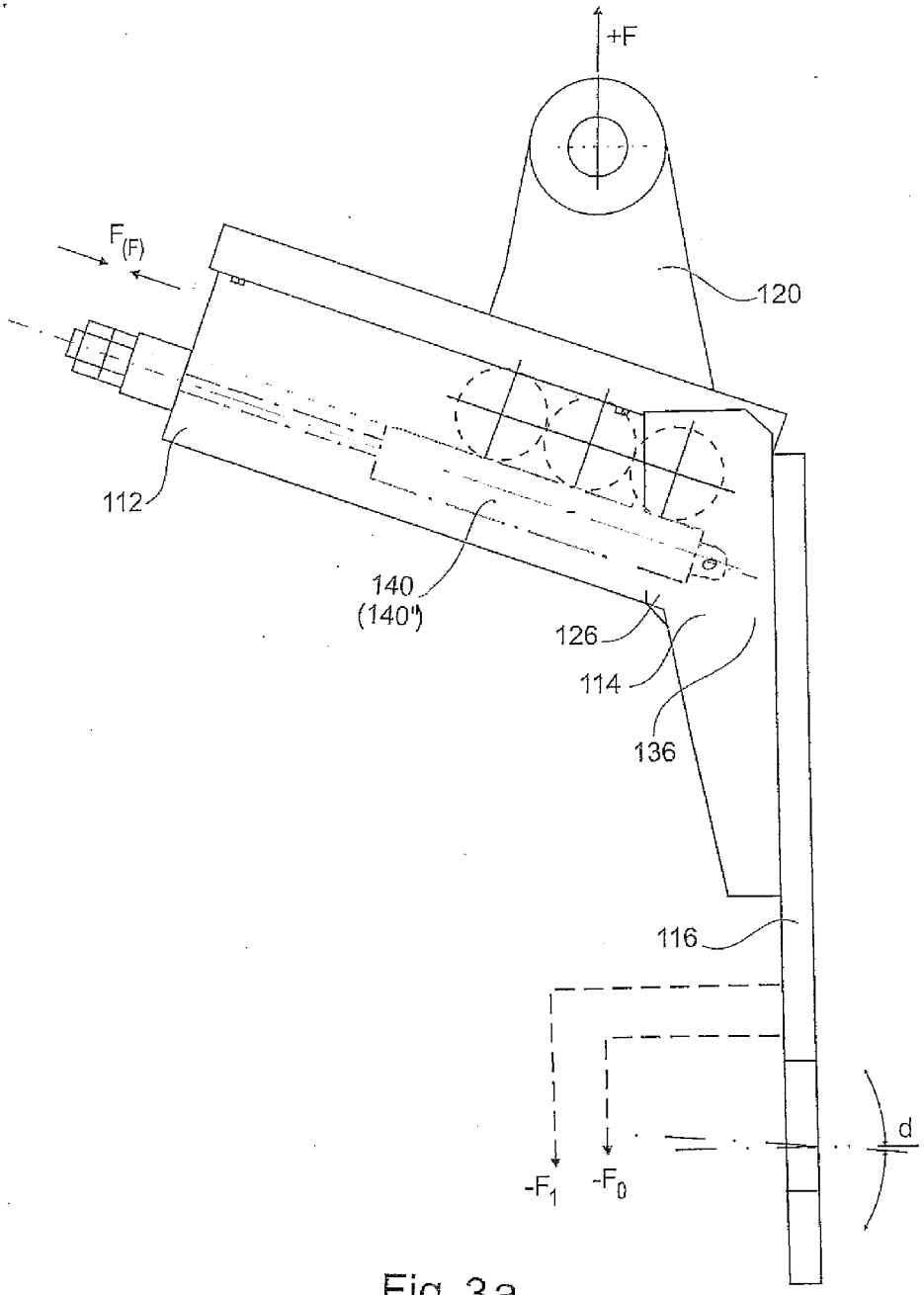
FIG. 3*a* a schematic view of the suspension device similar to that of FIG. 3 but with the damping member formed as a fluid cylinder.
Figure 4:
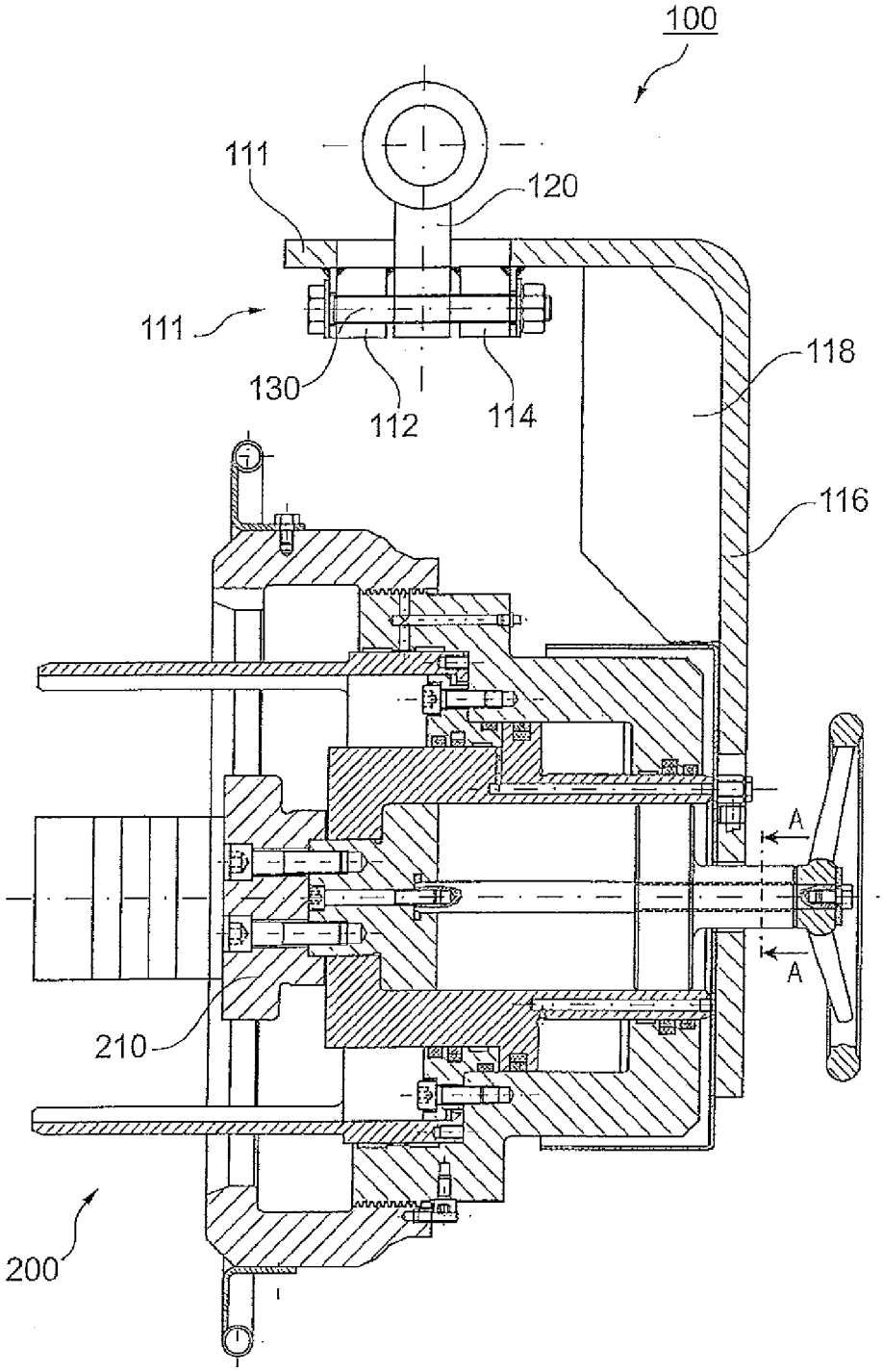
Fig. 4 PRIOR ART
FIG. 4 a side cross-sectional view of a prior art suspension device.

The bottom of the fishplate 120 is displaced over the guide rod 130 by a sliding block 126 that in case of load, acts against the spring (see FIG. 3). At the end of the suspending fishplate 120 on opposite sides thereof, there are provided running rollers 122 that support the base plate 111, supporting and displacing the lifting arm 110. The running rollers 122 are secured to the fish plate 120 with a nut 124. The running rollers 122 roll over the bottom of the base plate 111 upon displacement of the suspending fishplate 120. There exists a possibility, as shown in FIG. 3*a*, to form the damping member 140 as a hydraulic or pneumatic cylinder 140" or of a plastic element.

Figure 2:
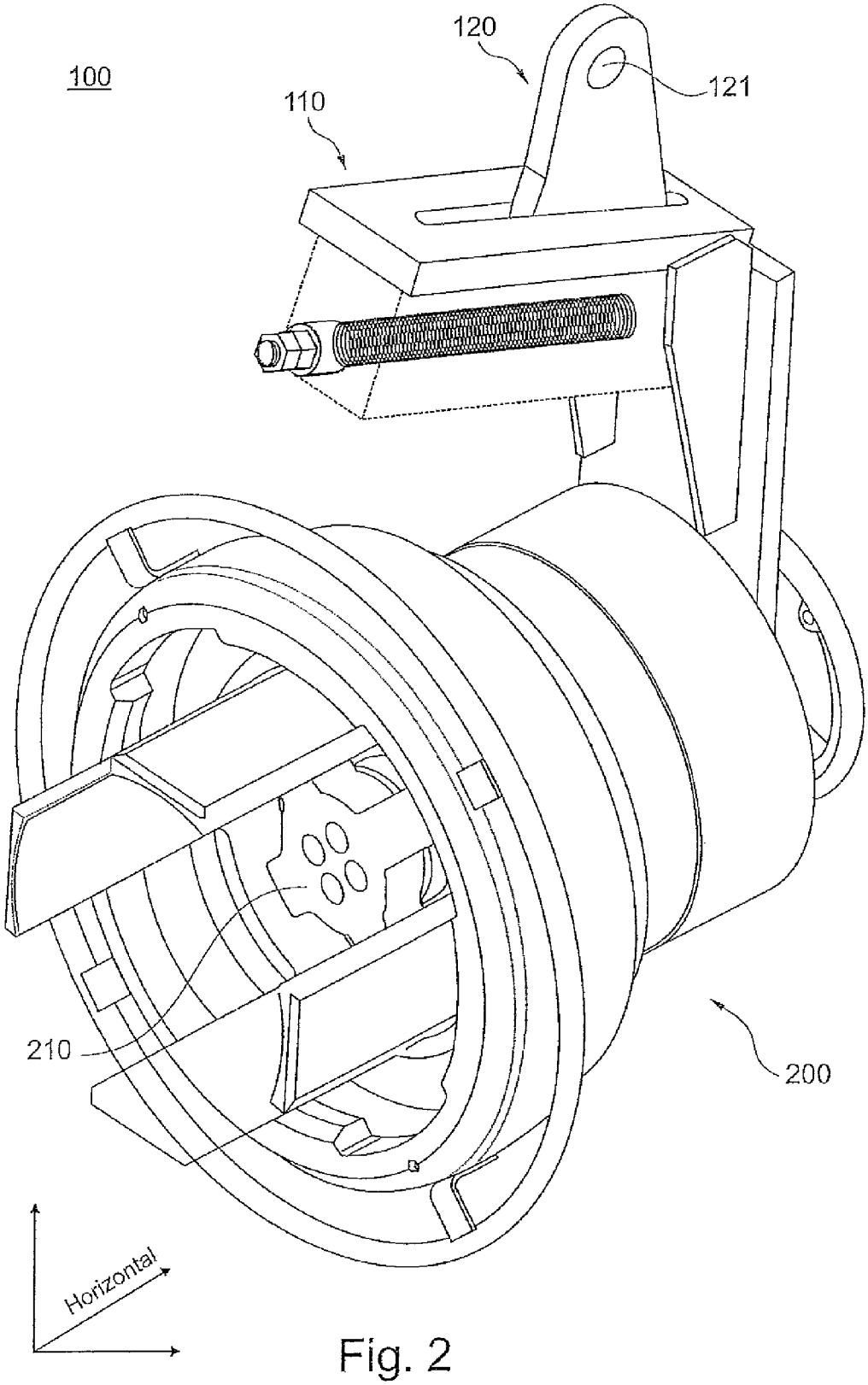
FIG. 2 a perspective view of the suspension device with the bearing-mounting tool received thereon.

FIG. 2 shows the suspension device 100 with a mounted thereon, bearing-mounting tool 200. At the upper end of the suspending fishplate 120, there is provided a suspension bore 121 for mounting the suspension device 110 on a lifting/support unit. The displacement of a piston 210 within the bearing-mounting tool 200 changes the torsion moment, resulting in a changed load applied to the suspension device 110, dependent on the position of the piston 210. The produced change of the position of the gravity center of the entire unit is picked up by the damping member 140, so that the suspension device 110 swings horizontally.

FIG. 3 shows distribution of forces in the suspension device 110. Dependent on the position of the piston 210 of the bearing-mounting tool 200, a force Fo, F1 . . . Fn acts on the suspension device 110. The corresponding counter-force is formed of a sum of friction forces which acts in a region between the bearing surface of a suspension hook of a lifting/support unit within the suspension bore 121 and the counter-force (F)(f) produced by the damping member 140.

When a load is applied to the suspension device 100 or, the mounting plate 116, a suspension take-off force is applied to the base plate 111. The take-off force acts in such a way that the base plate 111, together with the mounting plate 116 and the suspended load, rolls over an inclination plane formed by the running rollers 122 of the fishplate 120 (see FIG. 3). With the construction according to the present invention, the rolling of the base plate 111 results in compression of the damping member 140, the spring, whereby the counter-force to the suspension take-off force increases. This counter-force is designated in FIG. 3 as F(f). The rolling of the base plate 111 over the running rollers 122 ends when the counter-force and suspension take-off force become equal to each other. The suspension take-off force, excluding the mass of the base plate 111 and the mounting plate 116, is essentially represented by the mass of he suspended load 200.

Based on the individual mass distribution, a torsion moment or a torsion moment change of the entire structure, the suspension device 110 plus the suspended load, about the pivot axis in the suspension bore 121 is produced. The mass distribution or the torsion moment basically produces an individual swing position of the load, i.e., the load in the swing position, with its longitudinal axis being inclined at an individual inclination angle ($\alpha$) to a horizontal.

Advantageously, the stiffness of the damping member is so selected according to the invention that with a predetermined load, a predetermined desired inclination angle, e.g., O degree, to the horizontal is produced.

In the present case, in which the load is a bearing-mounting tool with a displaceable piston arranged therein, the stiffness of the spring is basically so selected that the tool, together with the piston, preferably, swings horizontally. Advantageously, the spring stiffness is so selected that the displacement of the piston within the tool does not cause any noticeable deviation of the inclination angle from a desired inclination angle. In case any fine adjustment or correction of the inclination angle is necessary, this can be carried out in separate cases with the above-described fine adjustment.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A suspension device for receiving a load, comprising:

a U-shaped lifting arm formed of a base plate and two legs extending at an angle to the base plate;

a mounting plate for receiving a load and provided on the lifting arm;

a guide rod extending between the legs of the U-shaped lifting arm;

a suspending fishplate displaceable along the guide rod for suspending the suspension device from a lifting/support unit; and a damping member arranged between one of the legs of the U-shaped arm and the suspension fishplate, with a stiffness of the damping member being so selected that a load is displaced at a predetermined angle to a horizontal, wherein the damping member is formed as a spring, and wherein the suspension device further comprises a tensioning device provided on at least one end of the guide rod for adjusting a preload of the spring and having a spacer sleeve, a first hexagonal nut used as a tensioning nut, and a second hexagonal nut used as a counter-nut.

2. A suspension device for receiving a load, comprising:

a U-shaped lifting arm formed of a base plate and two legs extending at an angle to the base plate;

a mounting plate for receiving a load and provided on the lifting arm;

a guide rod extending between the legs of the U-shaped lifting arm;

a suspending fishplate displaceable along the guide rod for suspending the suspension device; and a damping member arranged between one of the legs of the U-shaped arm and the suspension fishplate, with a stiffness of the damping member being so selected that a load is displaced at a predetermined angle to a horizontal, wherein the base plate of the lifting arm is provided with an elongate opening for receiving a suspending fishplate displaceable and differently positionable in the elongated opening in the base plate.

* * * * *

UNITED STATES PATENT AND TRADEMARK OFFICE

CERTIFICATE OF CORRECTION

PATENT NO. : 8,272,672 B2
APPLICATION NO. : 12/657200
DATED : September 25, 2012
INVENTOR(S) : Rolf Huecker et al.

It is certified that error appears in the above-identified patent and that said Letters Patent is hereby corrected as shown below:

Title page, Insert:

--(30) Foreign Application Priority Data

January 14, 2009 (DE) DE 10 2009 004 537
November 17, 2009 (DE) DE 10 2009 053 665--

Signed and Sealed this
Fourth Day of December, 2012

David J. Kappos

David J. Kappos
*Director of the United States Patent and Trademark Office*